US012220621B2

(12) United States Patent
Shen

(10) Patent No.: US 12,220,621 B2
(45) Date of Patent: Feb. 11, 2025

(54) GOLF TEE

(71) Applicant: Wei Shen Shen, Taichung (TW)

(72) Inventor: Wei Shen Shen, Taichung (TW)

( * ) Notice: Subject to any disclaimer, the term of this patent is extended or adjusted under 35 U.S.C. 154(b) by 0 days.

(21) Appl. No.: 18/451,668

(22) Filed: Aug. 17, 2023

(65) Prior Publication Data

US 2024/0058669 A1 Feb. 22, 2024

(30) Foreign Application Priority Data

Aug. 18, 2022 (TW) ..... 111208975

(51) Int. Cl.
*A63B 57/10* (2015.01)

(52) U.S. Cl.
CPC ..... *A63B 57/10* (2015.10)

(58) Field of Classification Search
CPC ..... A63B 57/10
USPC ..... D21/717
See application file for complete search history.

(56) References Cited

U.S. PATENT DOCUMENTS 1,554,721 A * 9/1925 Getchell ..... A63B 57/10 473/403
1,573,911 A * 2/1926 Budrow ..... A63B 57/10 473/401
2,082,811 A * 6/1937 Thorup ..... A63B 57/10 473/402
2,107,706 A * 2/1938 Morgan ..... A63B 57/10 473/390
3,907,289 A * 9/1975 Bondu, Sr. ..... A63B 57/10 473/403
4,192,504 A * 3/1980 Clugage ..... A63B 57/10 473/403
4,328,969 A * 5/1982 Wright ..... A63B 57/10 473/390
D268,356 S * 3/1983 Brisebois ..... D21/718
5,193,803 A * 3/1993 Flick, III ..... A63B 57/10 473/392
5,413,330 A * 5/1995 Disco ..... A63B 57/10 473/387
5,571,055 A * 11/1996 Lewis ..... A63B 57/10 473/402
5,683,313 A * 11/1997 Disco ..... A63B 57/19 473/387
6,004,228 A * 12/1999 Adam ..... A63B 57/19 473/403
6,062,990 A * 5/2000 Pierce ..... A63B 57/50 473/402

(Continued)

FOREIGN PATENT DOCUMENTS

WO WO-2012164709 A1 * 12/2012 ..... A63B 57/10
WO WO-2017124122 A1 * 7/2017
WO WO-2023245264 A1 * 12/2023

*Primary Examiner* — Steven B Wong
(74) *Attorney, Agent, or Firm* — MUNCY, GEISSLER, OLDS & LOWE, P.C.

(57) ABSTRACT

A golf tee has a shaft and a top plate. The top plate is mounted on a top of the shaft. The top plate has an up-facing ball-supporting surface. The shaft inclines toward a direction of stroke and is oblique with respect to the ball-supporting surface, so that the shaft and a center line of the ball-supporting surface include an inclination angle therebetween. The top plate further has a plurality of spaced bulges arranged along a rim of the ball-supporting surface. Thereby, the golf tee helps improve hitting accuracy and carry distance.

3 Claims, 6 Drawing Sheets

(56) References Cited

U.S. PATENT DOCUMENTS

| | | | | |
|---|---|---|---|---|
| 6,176,794 | B1 * | 1/2001 | Kim | A63B 57/10 473/392 |
| 7,691,011 | B1 * | 4/2010 | Roman | A63B 57/16 473/387 |
| 8,974,322 | B1 * | 3/2015 | Jones | A63B 57/10 473/387 |
| D864,323 | S * | 10/2019 | Ogando | D21/718 |
| 2004/0067802 | A1 * | 4/2004 | Salsman | A63B 57/10 473/387 |
| 2007/0021240 | A1 * | 1/2007 | Medved | A63B 57/10 473/392 |
| 2007/0066422 | A1 * | 3/2007 | Cirone | A63B 57/10 473/387 |
| 2009/0191983 | A1 * | 7/2009 | Otsubo | A63B 57/10 473/396 |
| 2012/0028734 | A1 * | 2/2012 | MacKeen | B05D 5/083 427/430.1 |
| 2014/0128180 | A1 * | 5/2014 | Imai | A63B 57/10 473/403 |
| 2014/0309057 | A1 * | 10/2014 | Reams | A63B 57/30 473/387 |

* cited by examiner

GOLF TEE

FIELD OF THE INVENTION

The present invention relates to golf accessories, and more particularly to a golf tee that helps improve hitting accuracy and carry distance.

BACKGROUND OF THE INVENTION

Generally, to drive off a golf ball, a golf tee stuck into the course ground is used to support the ball for facilitating ball shot and elevate the ball to adapt it to strokes with use of deferent golf clubs and desired ball striking performance.

A conventional golf tee typically has a shaft. The shaft has a lower end tapered to form a pinpoint to be thrusted into the ground and an upper end expanded to form a concave plate for a golf ball to place thereon. However, the conventional concave plate leads to a large contact area between its surface and the ball placed thereon, which in turn undesirably increases friction and even impact that deviate the ball from the desired flight path and reduce the flight distance of the ball during ball striking.

SUMMARY OF THE INVENTION

The primary objective of the present invention is to provide a golf tee that helps improve hitting accuracy and carry distance.

In order to achieve the foregoing objective, the present invention provides a golf tee, comprising: a shaft, having a stick-like body extending for a predetermined length; and a top plate, mounted on a top of the shaft, the top plate having an up-facing ball-supporting surface, the shaft inclining toward a direction of stroke and being oblique with respect to the ball-supporting surface, so that an axis of the shaft and a center line of the ball-supporting surface including an inclination angle therebetween, and the top plate further having a plurality of spaced bulges arranged along a rim of the ball-supporting surface.

Preferably, the shaft includes a body section and a pin section arranged in order from the top to a bottom of the shaft, in which the pin section has two outward-jutting, downward-tapered blade portions formed on two opposite sides of the shaft with respect to the direction of stroke. Further, each of the blade portions has a triangular cross-sectional shape, and each of the blade portions has an apex edge so that the two apex edges form two opposite sides of the pin section. Additionally, the pin section has a downward extended terminal expanded to form a downward-tapered pinpoint portion, in which the pinpoint portion has an upper edge contiguous to a lower edge of each of the blade portions so that a shoulder portion is formed between the pinpoint portion and each of the blade portions.

Preferably, the top plate is formed by a base portion connected to a top of the body section and a rubber layer covering a periphery of the base portion, and the bulges are integratedly formed on the rubber layer.

Preferably, the inclination angle is of between 13 and 18 degrees, and each of the bulges has a global or prismatic shape.

DETAILED DESCRIPTION OF THE INVENTION

Figure 1:
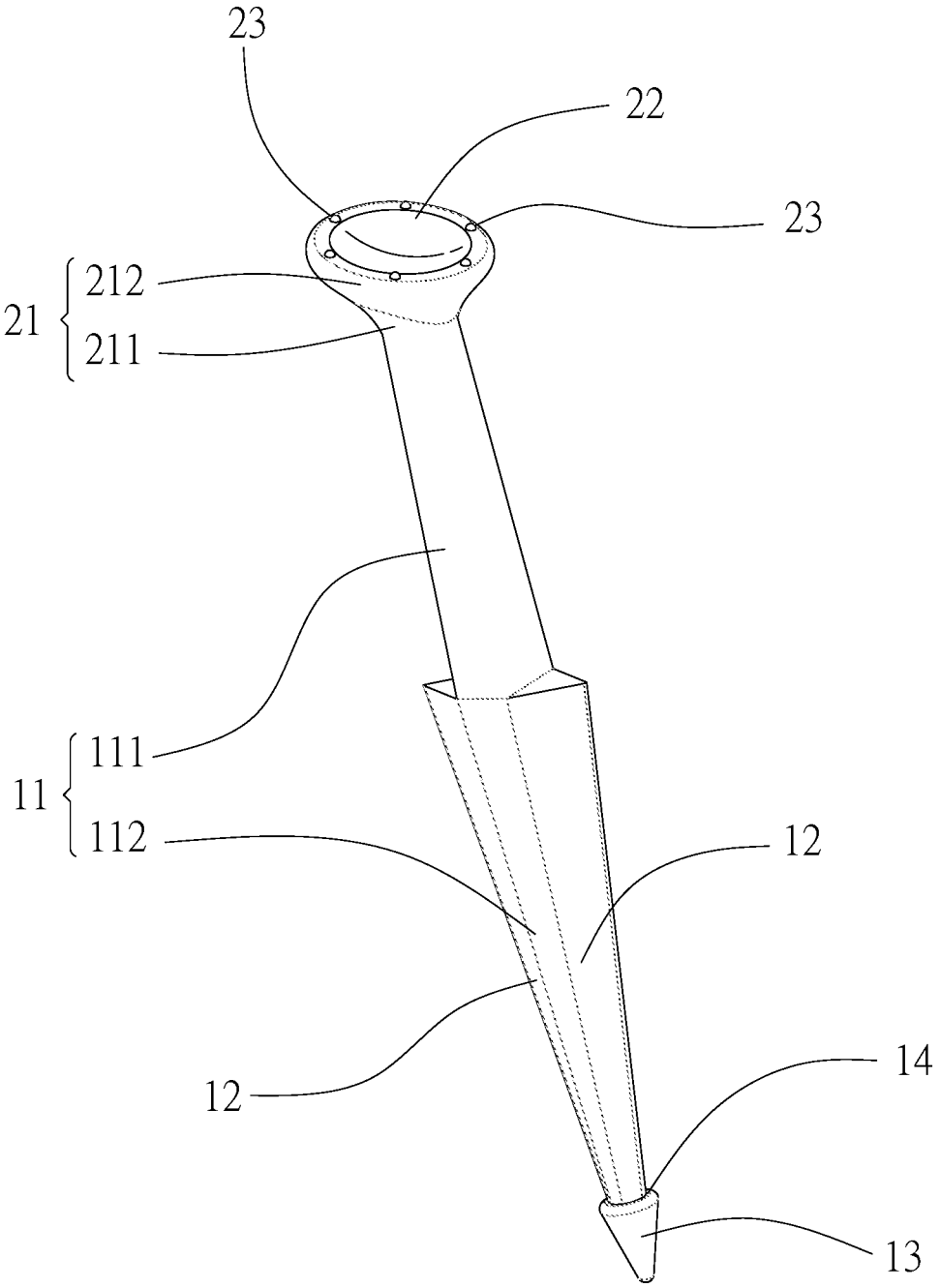
FIG. 1 is a perspective view of the present invention.
Figure 2:
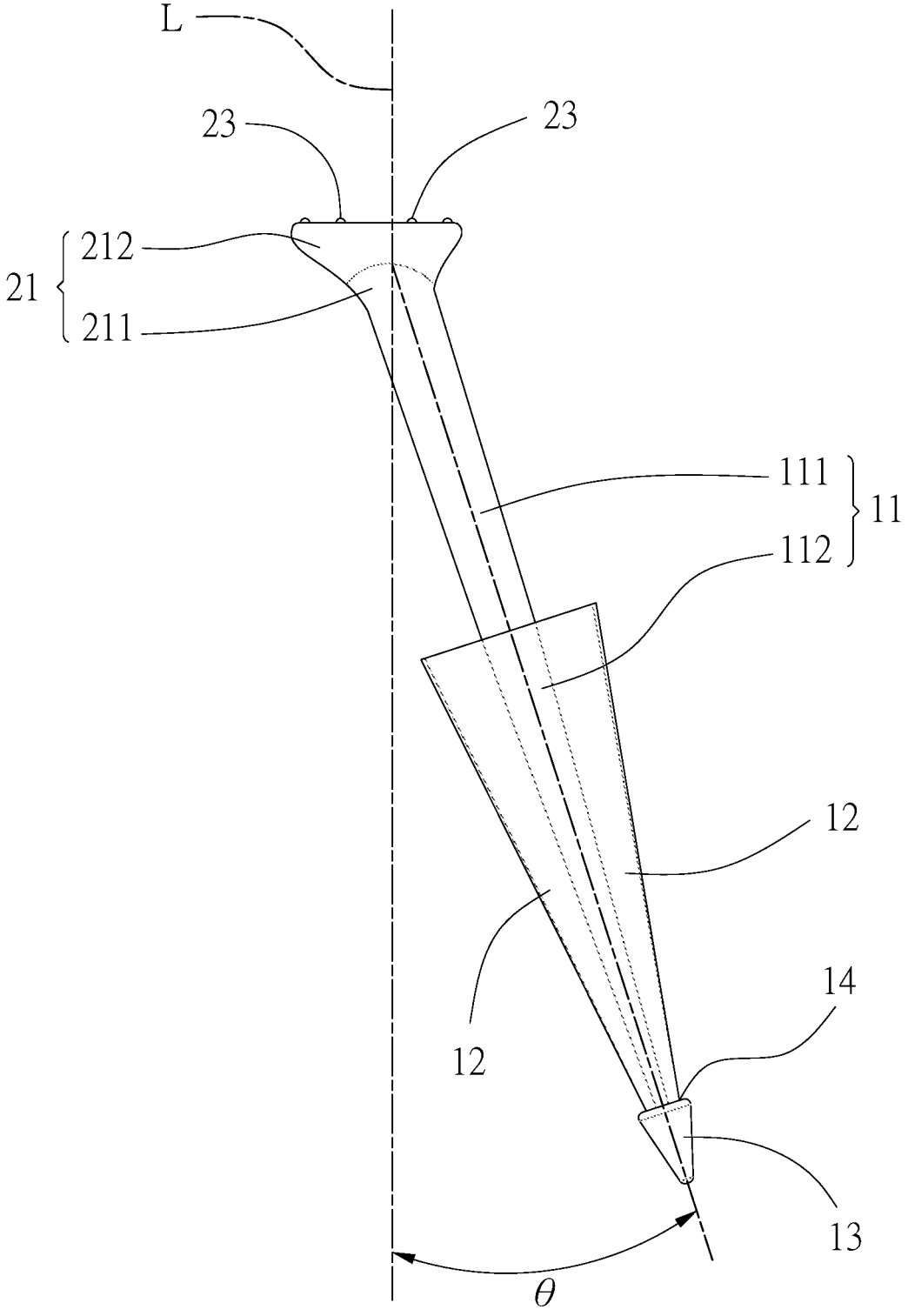
FIG. 2 is a front view of the present invention.
Figure 3:
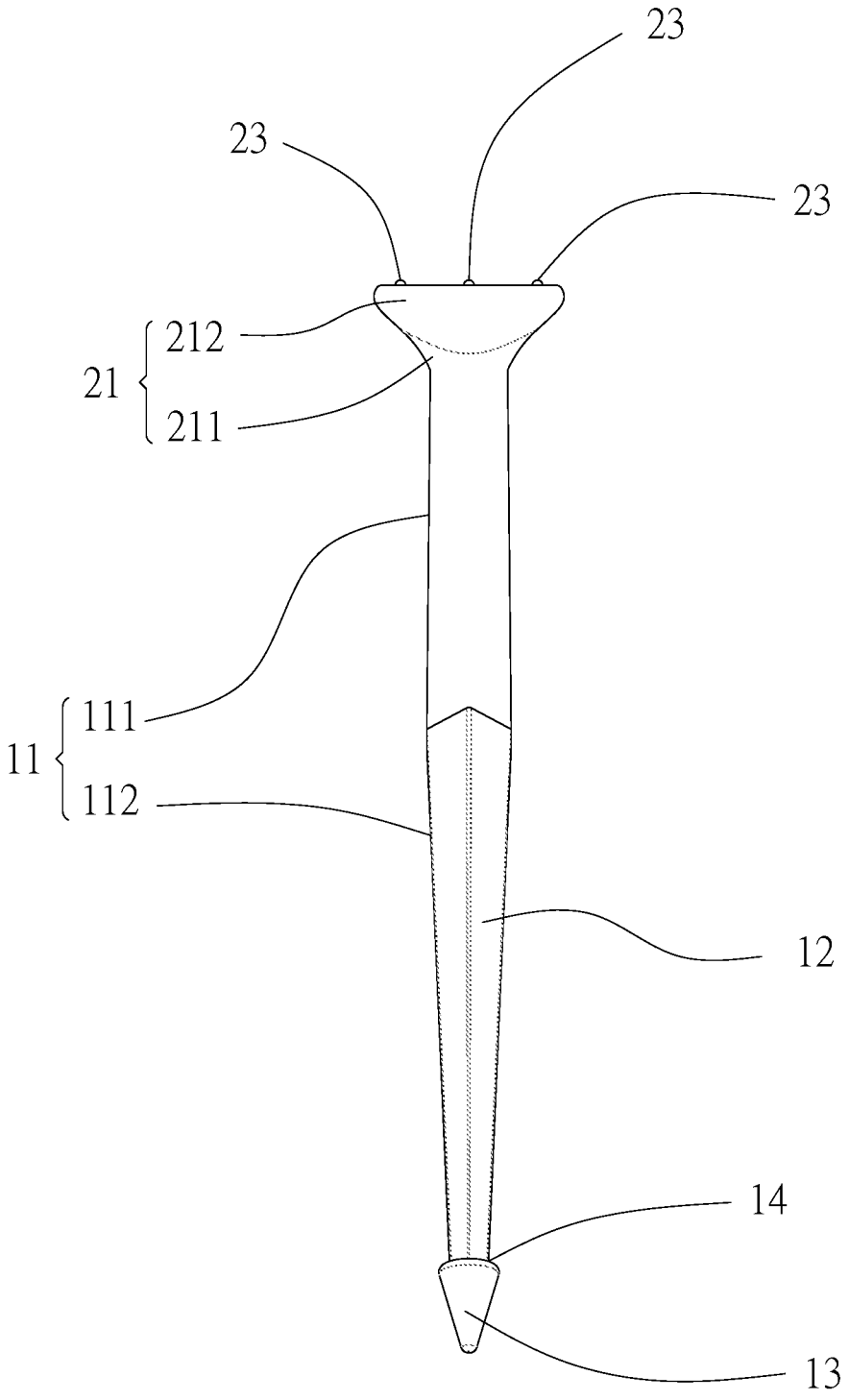
FIG. 3 is a side view of the present invention.

Referring to FIG. 1 through FIG. 3, a golf tee of the present invention comprises a shaft 11 and a top plate 21.

The shaft 11 has a stick-like body extending for a predetermined length. The shaft 11 includes a body section 111 and a pin section 112 arranged in order from the top to a bottom. The pin section 112 has two outward-jutting, downward-tapered blade portions 12 formed on two opposite sides of the shaft 11 with respect to the direction of stroke. In the present embodiment, each of the blade portions 12 has a triangular cross-sectional shape, and each of the blade portions 12 has an apex edge so that the two apex edges form two opposite sides of the pin section 112. The pin section 112 has a downward extended terminal expanded to form a downward-tapered pinpoint portion 13. The pinpoint portion 13 has an upper edge contiguous to a lower edge of each of the blade portions 12 so that a shoulder portion 14 is formed between the pinpoint portion 13 and each of the blade portions 12. Thereby, the shaft 11 can be easily stuck into the ground with the pinpoint portion 13 and the blade portions 12.

The top plate 21 is mounted on the top of the body section 111 of the shaft 11. The top plate 21 is formed by a base portion 211 connected to the top of the body section 111 and a rubber layer 212 covering the periphery of the base portion 21. In practical manufacturing, the base portion 211 may be integratedly formed on the top of the body section 111 and a soft rubber material is applied onto the base portion 211 through a rubber coating process to from the rubber layer 212. Therein, the top plate 21 is diametrally increased from bottom to top to form a cone-like structure. An up-facing ball-supporting surface 22 is formed at the top of the rubber layer 212 of the top plate 21. The ball-supporting surface 22 is slightly concaved and a plurality of spaced bulges 23 arranged along the rim of the ball-supporting surface 22 on the rubber layer 212. The shaft 11 inclines toward the direction of stroke and is oblique with respect to the ball-supporting surface 22, so that the axis of the shaft 11 and the center line L of the ball-supporting surface 22 include an inclination angle θ. In other words, the shaft 11 is connected to the top plate 21 in a bias pose. Preferably, the inclination angle θ is of between 13 and 18 degrees, and there are six bulges 23 equally spaced and distributed along the rim of the ball-supporting surface 22. Each of the bulges 23 has a global or prismatic shape. The bulges 23 thus work together to hold a golf ball on the ball-supporting surface 22.

Figure 4:
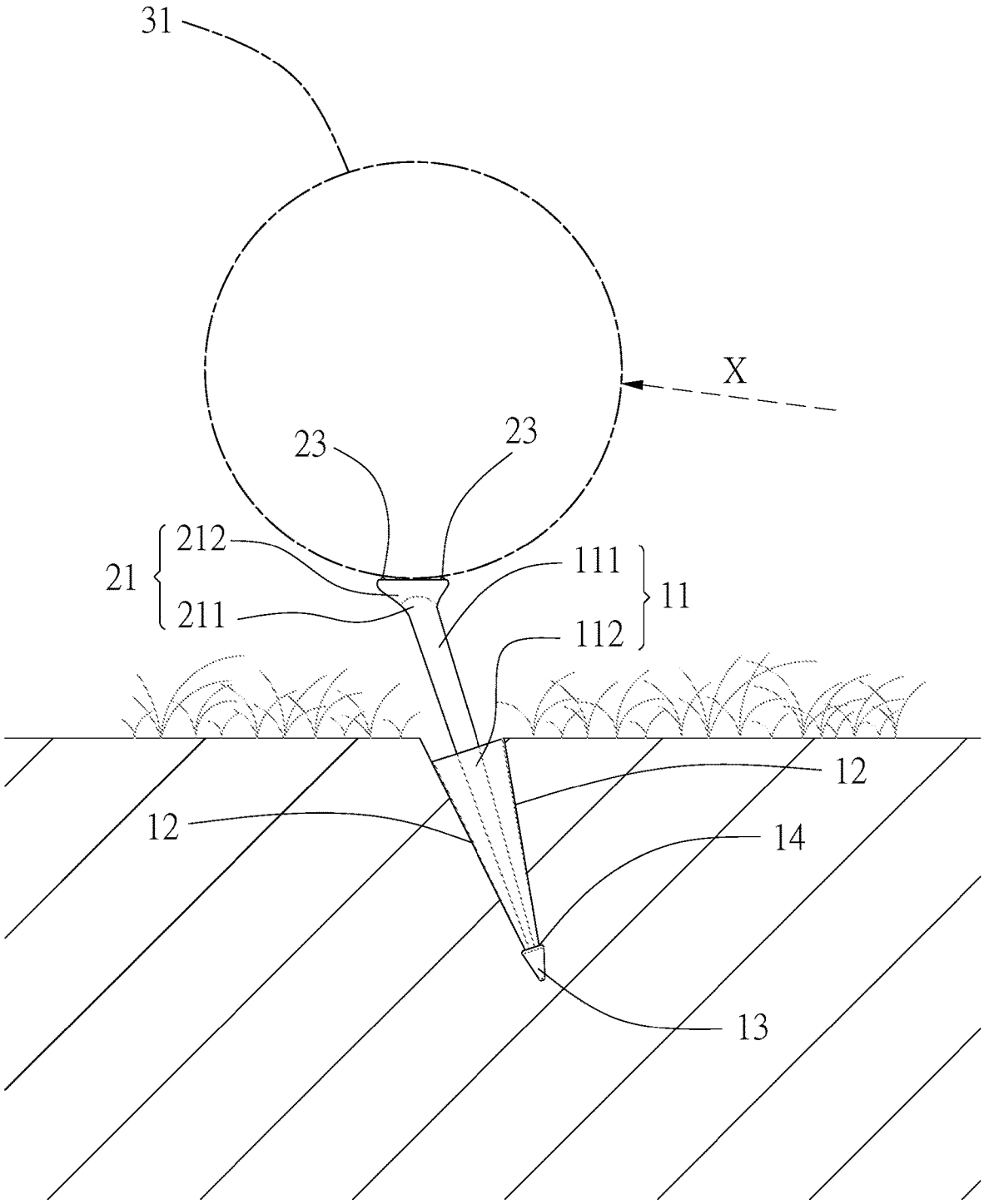
FIG. 4 is an applied view of the present invention.
Figure 5:
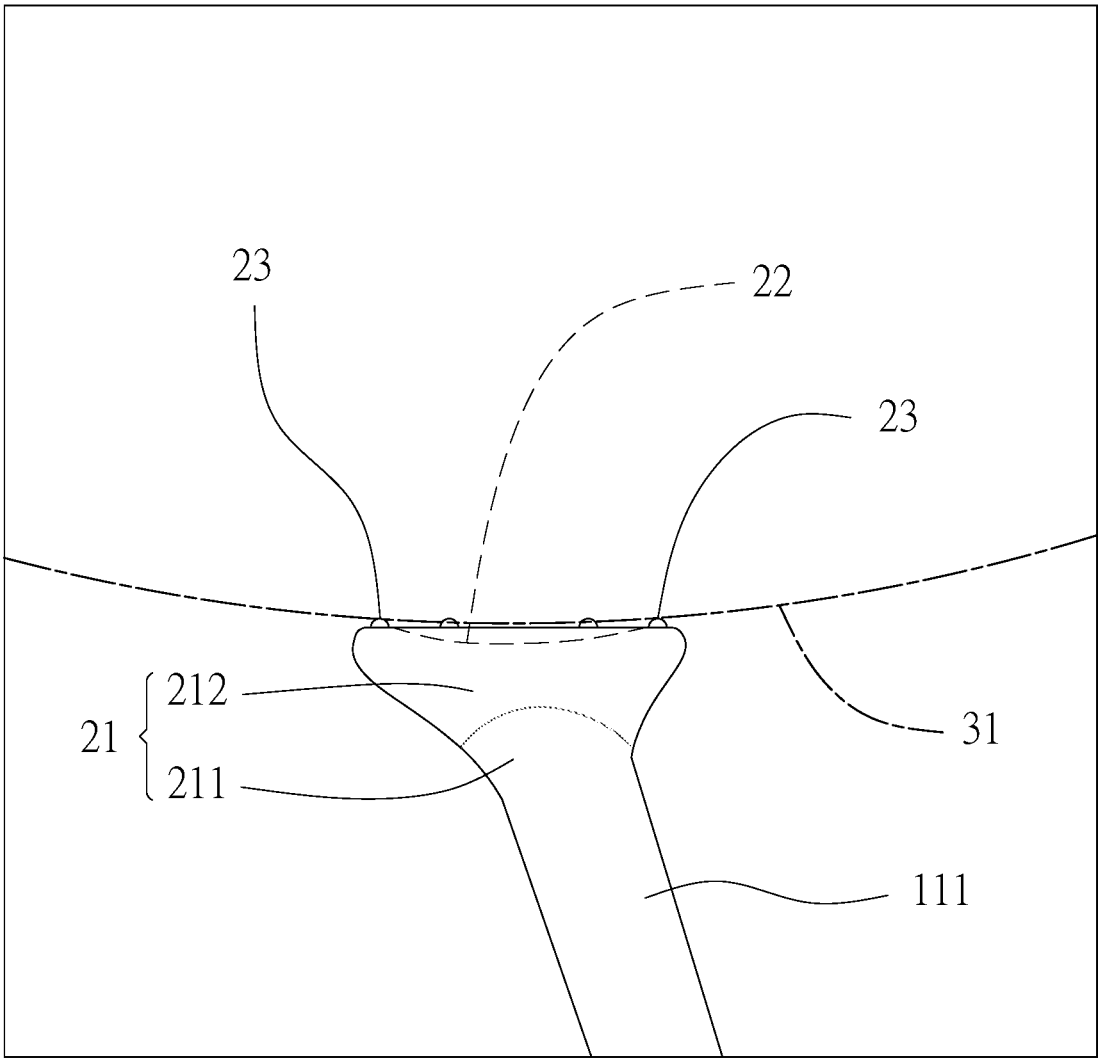
FIG. 5 is a local, zoom-in view of the marked area in FIG. 4.

With the configuration described previously, to use the disclosed golf tee, as shown in FIGS. 4 and 5, a user can stick the pinpoint portion 13 of the shaft 11 into the ground along the direction of stroke X so that the shaft 11 is forward-leaning posed. Then a golf ball 31 can be placed stably on the bulges 23 of the ball-supporting surface 22. By using the leaning posed shaft 11 for support, the weight load of the golf ball 31 born by the golf tee can be well distributed, so as to reduce the resistance happening when the golf ball 31 leaves the golf tee. In addition, the pinpoint portion 13 of the shaft 11 and the blade portions 12 at the two sides as provided by the present invention ensure stable and firm installation of the shaft 11 in the ground. Moreover, since the blade portions 12 on the pin section 112 are at two opposite sides with respect to the direction of stroke X, the golf tee of the present invention can stand firmer when receiving impact during ball striking.

Furthermore, in the present invention, the top plate 21 uses the bulges 23 formed on the elastic rubber layer 212 at its periphery to support the golf ball 31, and this makes the contact between the golf ball 31 and the golf tee be point contact, instead of surface contact as seen in the prior art. This significantly reduce resistance or interference acting on the stroked ball, and in turn helps enhance hitting accuracy and carry distance. Besides, when a user swings the club in the direction of stroke X, the leaning pose of the shaft 11 allows the momentum generated by the club to be efficiently transferred to the golf ball 31, making the golf ball 31 fly higher and farther in the sky, and roll longer after landing.

Additionally, the elastic rubber layer 212 covering the periphery of the top plate 21 inherits the anti-slip property of rubber, so as to better ensure that the bulges 23 on the rubber layer 212 support the golf ball 31 stably and firmly and prevent the golf ball 31 from accidently falling off. Furthermore, the rubber layer 212 covering the top plate 21, with its elasticity, also serves to damp the shock received by the golf tee during ball striking and fed back to the user's hands, thereby providing smoother and more comfortable ball-striking experience.

Figure 6:
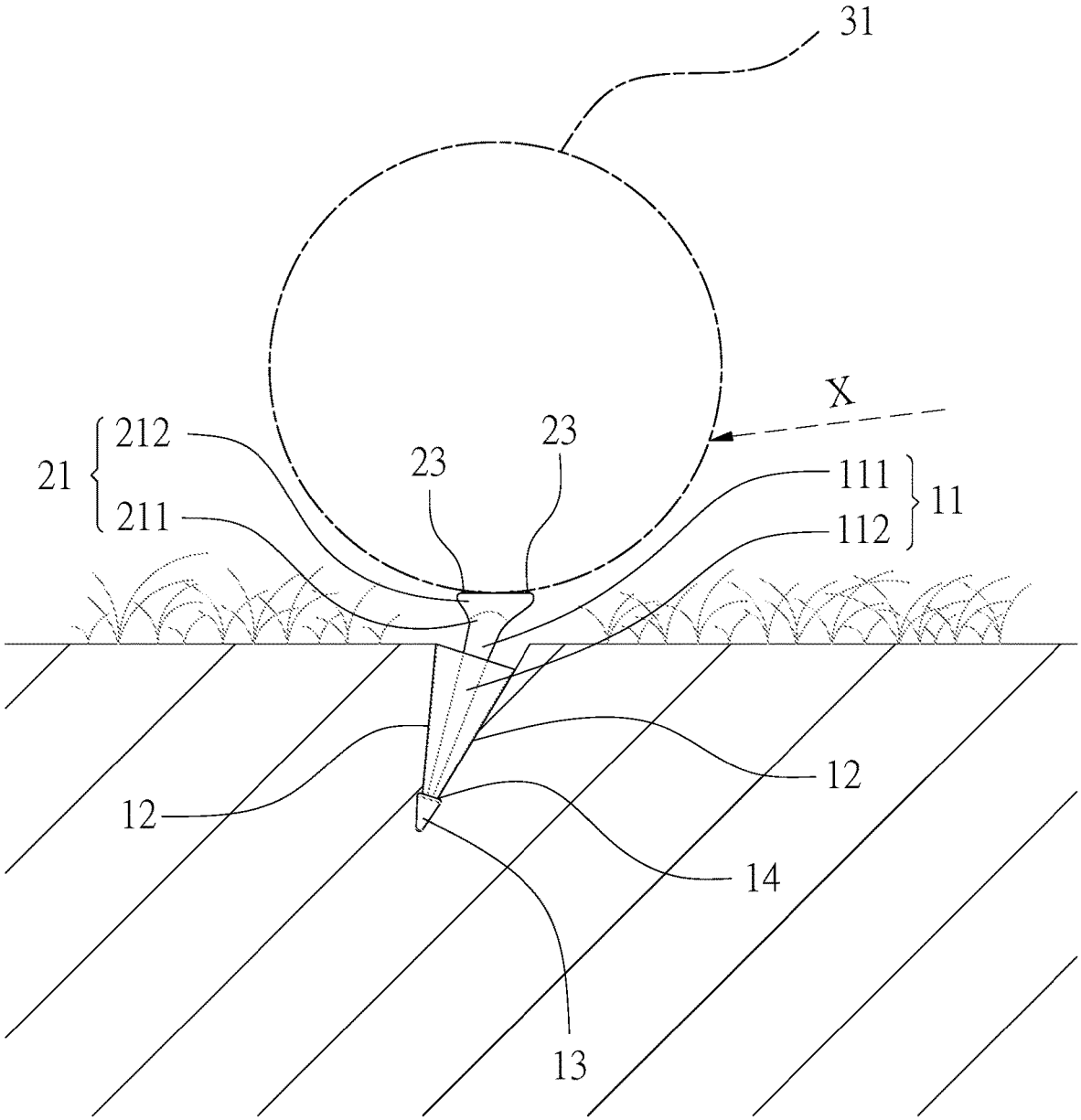
FIG. 6 is another applied view of the present invention according to a different embodiment.

Moreover, referring to FIG. 6, the present invention is applicable to a short tee that has a relatively short length and is often used during ball striking performed using a mid or short iron. As shown, the shaft 11 is stuck into the ground in a backward-leaning pose, so that during striking at a large attack angle such as a driving-off shot performed using a mid or short iron or where back spin of the flying ball is desired, the club face can easily avoid the shaft 11 and the top plate 21, thereby precisely achieving desired direction and distance of flight of the ball.

What is claimed is:

1. A golf tee, comprising:

a shaft, having a stick-like body extending for a predetermined length; and a top plate, mounted on a top of the shaft, the top plate having an up-facing ball-supporting surface, the shaft inclining toward a direction of stroke and being oblique with respect to the ball-supporting surface, so that an axis of the shaft and a center line of the ball-supporting surface including an inclination angle therebetween, and the top plate further having a plurality of spaced bulges arranged along a rim of the ball-supporting surface, wherein the shaft includes a body section and a pin section arranged in order from the top to a bottom of the shaft, in which the pin section has two outward-jutting, downward-tapered blade portions formed on two opposite sides of the shaft with respect to the direction of stroke, wherein each of the blade portions has a triangular cross-sectional shape, and each of the blade portions has an apex edge so that the two apex edges form two opposite sides of the pin section, wherein the pin section has a downward extended terminal expanded to form a downward-tapered pinpoint portion, in which the pinpoint portion has an upper edge contiguous to a lower edge of each of the blade portions so that a shoulder portion is formed between the pinpoint portion and each of the blade portions, wherein the top plate is formed by a base portion connected to a top of the body section and a rubber layer covering a periphery of the base portion, and the bulges are integratedly formed on the rubber layer, and wherein a lower edge of the rubber layer covers to a downwardly tapered peripheral top of the base portion.

2. The golf tee of claim 1, wherein the inclination angle is of between 13 and 18 degrees.

3. The golf tee of claim 1, wherein each of the bulges has a global or prismatic shape.

* * * * *